US006635812B2

(12) United States Patent
Roth et al.

(10) Patent No.: US 6,635,812 B2
(45) Date of Patent: Oct. 21, 2003

(54) STRING HOLDER FOR A MUSICAL INSTRUMENT

(75) Inventors: Ernst Heinrich Roth, Bubenreuth (DE); Wilhelm Roth, Bubenreuth (DE); Klaus Boehmer, Bubenreuth (DE); Georg Vochezer, Argenbuehl (DE)

(73) Assignee: Rudolf Wittner GmbH u. Co., Isny (DE)

( * ) Notice: Subject to any disclaimer, the term of this patent is extended or adjusted under 35 U.S.C. 154(b) by 0 days.

(21) Appl. No.: 10/155,145

(22) Filed: May 24, 2002

(65) Prior Publication Data

US 2002/0174761 A1 Nov. 28, 2002

(30) Foreign Application Priority Data

May 25, 2001 (DE) ..... 101 25 443
Aug. 31, 2001 (DE) ..... 101 42 587

(51) Int. Cl.[7] ..... G10D 3/00

(52) U.S. Cl. ..... 84/297 R; 84/299; 84/300; 84/301; 84/302

(58) Field of Search ..... 84/297 R, 299–302

(56) References Cited

U.S. PATENT DOCUMENTS

| | | | | |
|---|---|---|---|---|
| 490,213 A | * | 1/1893 | Owen et al. | 84/299 |
| 1,791,977 A | * | 2/1931 | Seckendorf | 84/302 |
| 2,481,362 A | | 9/1949 | Straton | |
| 2,680,987 A | | 6/1954 | Straton | |
| 2,971,422 A | | 2/1961 | Passa | |
| 4,224,857 A | | 9/1980 | Infeld | |
| 5,883,318 A | | 3/1999 | Deutsch | |

FOREIGN PATENT DOCUMENTS

| | | |
|---|---|---|
| CH | 160465 | 3/1933 |
| DE | 7 123 032 | 9/1971 |
| DE | 28 45 241 | 4/1979 |
| DE | 195 15 166 | 10/1995 |
| DE | 297 12 635 | 1/1998 |
| EP | 0 242 221 | 10/1987 |
| EP | 0 273 499 | 7/1988 |

OTHER PUBLICATIONS

Extract from catalogue of Rudolf Wittner GmbH u. Co., Jul. 1997.

* cited by examiner

*Primary Examiner*—Shih-Yung Hsieh
(74) *Attorney, Agent, or Firm*—Barry R. Lipsitz

(57) ABSTRACT

In order to provide an easily usable string holder for a musical instrument with a holding body, on which a holding device for strings of the musical instrument is disposed and which is provided with an attachment element forming an attachment bow for fixing the holding body to the musical instrument, it is proposed that an adjusting device for adjustment of the distance of an attachment bow apex of the attachment element from the holding body be disposed on the holding body, and that the adjusting device be constructed to be operable from outside the holding body.

31 Claims, 4 Drawing Sheets

STRING HOLDER FOR A MUSICAL INSTRUMENT

The present disclosure relates to the subject matter disclosed in German applications No. 101 25 443.1 of May 25, 2001 and No. 101 42 587.2 of Aug. 31, 2001, which are incorporated herein by reference in their entirety and for all purposes.

BACKGROUND OF THE INVENTION

The invention relates to a string holder for a musical instrument with a holding body, on which a holding device for strings of the musical instrument is disposed and which is provided with an attachment element forming an attachment bow for fixing the holding body to the musical instrument.

Such string holders are used, for example, for fixing strings to violins, violas, cellos or double basses. In this case, the string holder is fixed by means of the attachment element to a saddle button of the musical instrument, one end of the strings of the musical instrument being fixed to the string holder via the holding device and the other end of the strings being fixed, for example, to a peg box of the musical instrument.

String holders are shown or described, for example, in DE 195 15 166 A1, EP 0 242 221 A2, DE 297 12 635 U1, U.S. Pat. No. 5,883,318, DE 28 45 241 A1 or EP 0 273 499 A1.

In a string holder known from the prior art a recess is disposed on an underside of a corresponding holding body. The respective ends of the attachment element are guided into the recess via two cutouts and the ends of the attachment element are provided with a thread. A knurled nut is disposed at both ends and the extent of the attachment bow can be varied by this.

The object forming the basis of the invention is to provide a string holder of the aforementioned type which is easily usable.

SUMMARY OF THE INVENTION

This object is achieved according to the invention with a generic string holder in that an adjusting device for adjustment of the distance of an attachment bow apex of the attachment element from the holding body is disposed on the holding body, and that the adjusting device is operable from outside the holding body.

In a stringed instrument such as a violin, viola, cello or double bass, for example, it is not only the tension under which the string stands that is significant for the tone, but also the ratio of the primary string to the secondary string. The primary string is the string region which is located between a saddle and a bridge and the secondary string is the string region which is located between the bridge and the string holder. Because an adjusting device for adjustment of the distance of an attachment bow apex of the attachment element in relation to the holding body, and therefore in relation to the holding device is provided according to the invention on the holding body, the length of the secondary string can be adjusted via the string holder. Since the adjusting device may be operated from outside the holding body, the strings do not need to be released at the pegs of the musical instrument and the string holder detached from the musical instrument in this case. Instead, the adaptation of the ratio of the length of the primary string to the secondary string may be adjusted with the musical instrument stringed. Necessary corrections can thus be easily made. The outside of the string holder in this case is the region of the string holder which does not face the musical instrument and in particular a covering board of the musical instrument.

Since the attachment element is under tension when the string holder is fixed, this attachment element can stretch. As a result, the length of the secondary string in turn changes. These stretching movements can be compensated easily according to the invention by the adjusting device by the distance of the attachment bow apex being subsequently adjusted accordingly.

The fact that the adjusting device may be operated from outside the holding body firstly enables the adjustment to be conducted easily. Secondly, it enables damage in particular to the surface of the musical instrument to be prevented, since the operation of the adjusting device is easily accessed.

It is particularly advantageous if the adjusting device comprises an adjusting element for adjusting the distance of the attachment bow apex, and, in particular a single adjusting element, which may be operated from outside the holding body. This single adjusting element then enables the distance of the attachment bow apex from the holding device for the strings to be adjusted easily.

For easy adjustability in this case, the adjusting element may be operated advantageously from an end of the holding body remote from the holding device for the string of the musical instrument and in particular from an end of the holding body, via which the attachment element is connected thereto. As a result of this, the risk of damage to a surface of the musical instrument, e.g. by means of a screwdriver for operation of the adjusting element, is minimized, since the impact area of the screwdriver on a covering board of the musical instrument is minimized. Moreover, in such an arrangement the adjusting device can be constructed in a structurally simple manner, and therefore simply with respect to production, since the direction of the change in the distance of the attachment bow apex from the holding device (the holding body) essentially coincides with the direction of access to the adjusting element. In particular, this also then allows the adjusting element of the adjusting device to retain its translational position relative to the musical instrument, i.e. not to move in a translational manner to the musical instrument, while the distance of the attachment bow apex is changed. This ensures that when, for example, the length of the secondary string is decreased and the string holder shifts in the direction of the bridge, the position of the impact point for the adjusting element for its operation does not lie deeper above the covering board of the musical instrument, and thus the risk of damage to the musical instrument is not increased, e.g. by a screwdriver.

It is beneficial if the adjusting device is disposed on an underside of the holding body which has a trough-shaped construction at least in the region of the adjusting device. This enables the adjusting device to be covered by the holding body to the outside and in particular towards an upper side, when the string holder is disposed on the musical instrument, i.e. the underside of the string holder points to a covering board of the musical instrument.

It is most particularly advantageous if the adjusting element is capable of translational movement relative to the holding body and in particular the adjusting element is capable of translational movement essentially parallel to a longitudinal direction of the holding body. As a result of this translational movement the distance of the apex of the attachment bow of the attachment element in relation to the holding device can then be adjusted. However, when a string holder is fixed to the musical instrument, this also enables the adjusting element to be fixed relative to the musical instrument in a translational manner, i.e. a rotation of the adjusting element leads to a displacement of the apex of the attachment bow relative to the holding body, but not to a displacement of the adjusting element relative to the musical instrument.

It is favorable from the design point of view if the adjusting element is an adjusting screw. Such an adjusting screw may be operated easily in order to generate a translational movement by means of a rotational movement, e.g. caused by a screwdriver, this translational movement changing the distance of the apex of the attachment bow of the attachment element from the holding body.

Such a change in distance may be achieved in a simple manner with respect to production if a threaded guide device, e.g. via a nut for an adjusting screw, is disposed to be secure against rotation and non-displaceable on the holding body, so that upon rotation of the adjusting screw relative to the holding body said screw is capable of translational displacement. Therefore, upon rotation of the adjusting screw its translational position relative to the holding body then changes, and as a result the distance of the apex of the attachment bow from the holding body may itself be adjusted.

To substantially prevent vibrating of the adjusting element in particular, it is beneficial if a sliding guide device is provided for the adjusting element, this guide device being disposed in particular at a distance from the threaded guide device. This enables the guide device to be constructed with greater play with respect to the apex of the attachment bow of the attachment element.

The adjusting device is favorably constructed essentially symmetrically in relation to a longitudinal axis of the holding body. This enables a uniform adjustment of the distance with respect to the attachment bow.

It is most particularly advantageous if, by operating the adjusting element when an attachment element is attached to the musical instrument and strings of the musical instrument are held via the holding device, a distance of the attachment bow apex from the holding body is adjustable, so that upon adaptation of the length of the secondary strings the strings do not need to be released from pegs of the musical instrument. Moreover, compensation of the stretch of the attachment element may then also be conducted without the string holder having to be detached from the musical instrument.

In an advantageous variant of an embodiment, an attachment element is provided with a thread in the region of its ends. For example, the attachment element is formed by a threaded plastic wire, which is sheathed outside the region of the ends and is sheathed in particular in the region of the attachment bow, which is looped on the saddle button of the musical instrument. A holding element can be screwed on, and in particular a knurled nut, via the thread in the region of the end of an attachment element. In turn, this knurled nut enables the attachment element to be fixed to a cross element, i.e. one end of the attachment element is fixed with respect to the cross element and the other likewise. In this case the thread enables the distance between the end and the cross element to be adjusted and with it the length of the attachment bow.

Thus, it is particularly favorable if the attachment element for the formation of an attachment bow is held on a cross element by means of a first bow element and a second bow element. In turn, this cross element may be displaced via the adjusting device and thus the attachment bow may be displaced as a whole to allow the distance of the apex of the attachment bow from the holding body to be adjusted. As a result, the string holder can be produced according to the invention by few parts: for provision of the mobility of the adjusting element, a tongue must be provided on an underside of the holding body, the adjusting element being rotatable relative to this tongue, and in this case the rotation of the adjusting element can be converted into a translational movement of the adjusting element. For this, for example, a nut, in which the adjusting screw is rotated, is disposed in the tongue to be secure against rotation and non-displaceable. In addition, a cross element is provided, to which the attachment element for the formation of an attachment bow is fixed by means of knurled nuts, for example. These knurled nuts, i.e. the free ends of the attachment element, and the adjusting element can be guided in a bridge element, which is formed in particular in one piece on the underside of the holding body. This enables an adjusting device to be constructed with few structural parts (holding body, adjusting element, threaded guide, two knurled nuts, attachment element and cross element). The string holder according to the invention can be produced in a simple manner in view of the corresponding low number of structural parts.

A bow element is then held on the cross element via a holding element, the holding element being disposed between an end of the bow element and the cross element. The size of the attachment bow may be adjusted by varying the distance towards the end.

It is particularly advantageous if the cross element has an abutment surface for the holding element which is angled. When the attachment element is under tension, when the strings of the musical instrument are under tension, the holding elements are then displaced accordingly as a result of the in particular slightly angled abutment surface and are no longer oriented completely parallel to the longitudinal direction of the holding body. As a result of this, these are in turn clamped to walls of a recess, in which the holding elements are guided, so that the free ends of the attachment element are clamped with the holding body. This substantially prevents a possible swishing sound of the attachment element which causes disruptive extraneous noise.

In this case, the holding element is advantageously formed by a knurled nut. Via such a knurled nut, on the one hand, the first bow element and the second bow element may be fixed to the cross element and, on the other hand, the length of the attachment bow may be adjusted via the position of the knurled nut relative to the end of a bow element. In order to adjust a defined length of the attachment bow, it is advantageous if the distance between the end of a bow element and the holding element is adjustable.

A string holder may be produced in a simple and inexpensive manner if the cross element can be positioned in a translational manner in relation to the holding body via the adjusting device. Since the attachment element is fixed to the cross element for formation of the attachment bow, the apex of the attachment bow in relation to the holding body and thus in relation to the holding device of the holding body is also positioned as a result of this via a translational movement of the cross element. This, in turn, enables the adjusting element itself to be firmly positioned against translational movement with respect to the musical instrument and to only be rotatable in relation to this, so that the distance of the apex of the attachment bow from the holding body is easily adjustable.

It is favorable if a sliding guide device is provided for the respective part of the first bow element and the second bow element, which lies between the respective end and the cross element. This guide device ensures, on the one hand, that the free ends of the attachment element are guided and, on the other hand, do not lie freely on the underside of the string holder, so that vibrations of the attachment element are substantially prevented.

It is additionally favorable if the sliding guide device is formed by a recess in a bridge element. Such a bridge element may be disposed on the string holder in one piece and be produced integrally as a holding body in the case of an injection molded plastic part, for example.

It can also be provided that a guide device for the adjusting element is formed in the bridge element to thus keep the production expense low.

A specific adjustment range of the adjusting device is advantageously predetermined, e.g. in a length range of approximately 5 to 7 mm, so as not to predetermine the possible variations too extensively for the user.

It is most particularly advantageous if in the arrangement on a musical instrument, the relative translational position of the adjusting element to the musical instrument is retained. This enables the adjusting element to always be operated from the same access area, irrespective of the position of the string holder in relation to the musical instrument, i.e. of the length of the secondary string. In particular, this prevents an operating end of the adjusting element, e.g. a head of an adjusting screw, from shifting in the direction of the bridge of the musical instrument when the distance of the apex of the attachment bow of the attachment element in relation to this bridge is changed. Therefore, this prevents the operating end of the adjusting element from being moved deeper into the area of the covering board of the musical instrument.

A securing means to prevent loss is advantageously provided for the attachment element when the adjusting element is released. This prevents the attachment element from detaching from the holding body, even when the adjusting element is released.

In particular, the cross element has one or more holding lugs for this, e.g. in the form of catch lugs, which is or are guided in a guide recess of the holding body and by means of which a movement of the cross element away from the holding body can be blocked. Thus, the guide recess restricts, in particular with side walls, the displaceability of the holding lug or lugs and thus blocks the ability of the cross element with the attachment element to be pulled away from the holding body.

In this case, the holding lug is advantageously disposed on a tongue of the cross element. The tongue can then extend through a bridge element, for example, to thus form a large distance between a rear end of the cross element and a front end thereof, which is formed by the tongue. This in turn allows a type of tilt lock to be simply formed by means of the adjusting element, which prevents the cross element, and thus the tongue, from tilting so that the holding lug remains inserted in the guide recess. Since this blocking effect is caused by the adjusting element, which in particular is an adjusting screw, it may also be released by loosening the adjusting screw. Therefore, if the adjusting element is drawn further out of the cross element, the blocking effect may be removed. In this case, guidance of the adjusting element in the cross element and/or in the bridge element for a translational movement is advantageously configured so that only a low play is present so that an application of force is necessary to draw out the adjusting screw.

Therefore, it is advantageous if the holding lug is disposed and configured in such a way that exit from the guide recess can be blocked via the adjusting element. So long as the holding lug is held in the guide recess by means of the adjusting element, the cross element can not be removed with the attachment element from the holding body.

In particular, with the adjusting element positioned above the holding lug, exit from the guide recess is blocked, since a tilting movement of the cross element, for example, is essentially blocked, via which the holding lug could be guided out of the guide recess and the cross element could be removed.

In this case, the guide recess between a threaded guide for an adjusting screw as adjusting element and a bridge element of the holding body is advantageously disposed on said holding body or is formed therein. In this way, the holding lug may be blocked from emerging from the guide recess via the adjusting element in the form of an adjusting screw, and this blocking is then itself achieved if the adjusting screw is not disposed in the threaded guide itself, but is drawn back in relation to this in the direction of the bridge element.

The following description of a preferred embodiment serves to explain the invention in more detail in association with the drawing.

DETAILED DESCRIPTION OF THE INVENTION

Figure 1:
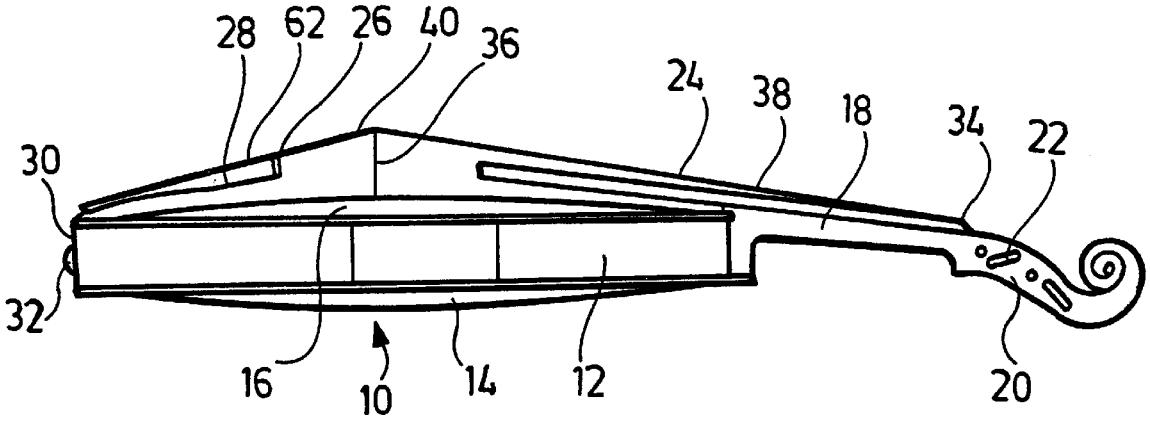
FIG. 1 is a side view of a violin, in which the strings are held on the musical instrument by means of a string holder.

As shown in FIG. 1, a violin 10 has a side wall 12 with a base board 14 and a covering board 16. Disposed on the side wall 12 is a finger board 18 on which, in turn, a peg box 20 sits. The peg box 20 has pegs 22, via which strings 24 of the violin 10 may be fixed at one string end to the peg box 20.

At its other end 26 a string 24 is fixed to a string holder 28 which may be in the form of a tailpiece. This string holder 28, in turn, has an attachment element 30 forming an attachment bow and held on the side wall 12 looped over a saddle button 32.

If the end 26 of a string 24 is firmly held relative to the side wall 12 via the string holder 28, then the tension on the string 24 may be changed via the associated peg 22 and this string can thus be tuned. The part of the string 24, which is located between a saddle 34 on the finger board 18 and a bridge 36 disposed on the covering board 16, is termed the primary string 38 and the part of the string 24, which is located between the bridge 36 and the string holder 28, is termed the secondary string 40.

The musical sound of the violin 10 is not only dependent on the tension exerted on the respective strings 24 via the pegs 22, but also on the ratio of the length of the primary string 38 to the length of the secondary string 40.

Figure 2:
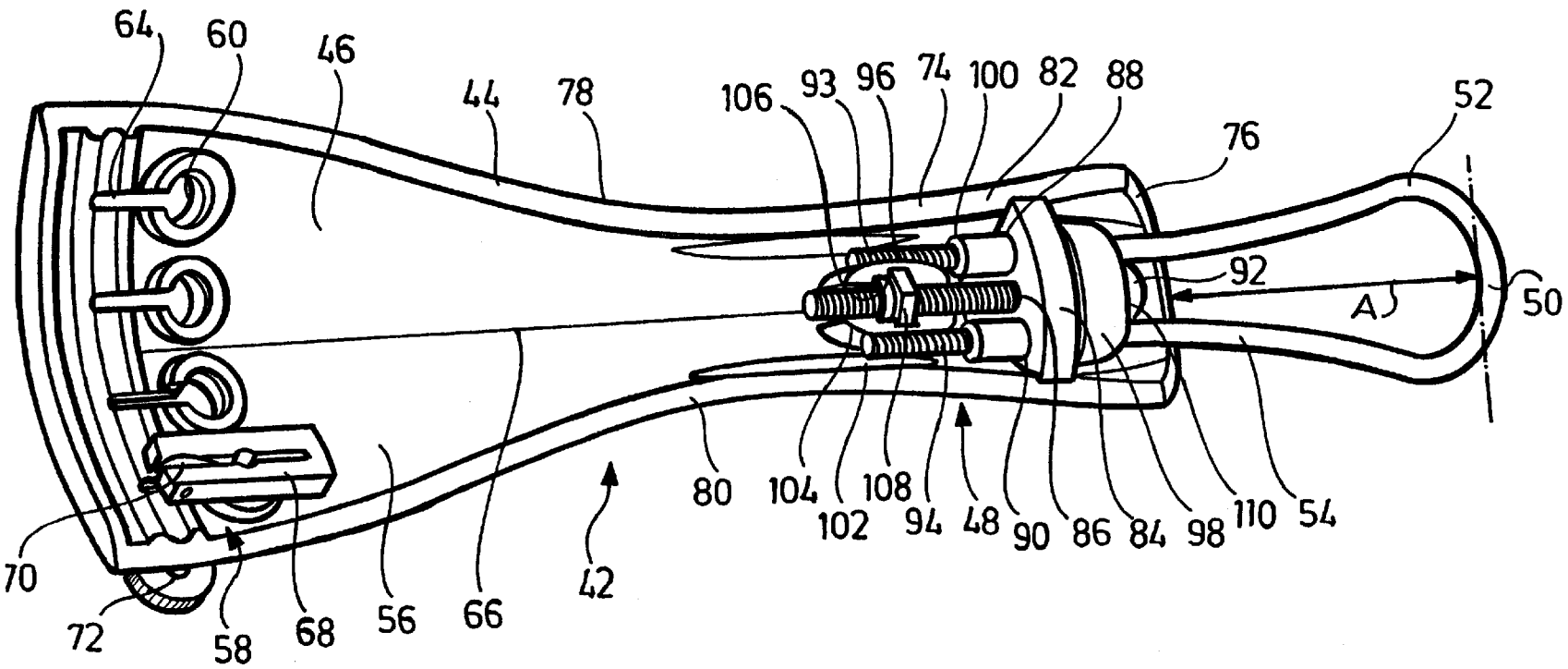
FIG. 2 is a perspective view onto an underside of an embodiment of a string holder according to the invention.

In an embodiment of a string holder according to the invention, given the overall reference 42 in FIG. 2, a holding body 44 is provided. This is made, for example, from wood, a plastic material or an aluminum diecasting. The holding body 44 has a trough-shaped underside 46, on which an adjusting device, given the overall reference 48, is disposed, via which a distance A of an apex 50 of an attachment bow 52 of an attachment element 54 in relation to the holding body 44 is adjustable, and in particular is also adjustable when the string holder 42 is looped on the saddle button 32 of the violin 10 via the attachment bow 52 and the strings 24 are fixed to the string holder 28 and to the violin 10. The attachment element or hanger 54 is, e.g., in the form of a string or a wire.

The holding body 44 has a front region 56, on which a holding device 58 for the strings 24 of the violin 10 is disposed, to enable these to be fixed to the holding body 44. In the case of a violin 10 with four strings 24, four round recesses 60, for example, are formed for this purpose in the holding body 44, which run continuously from an upper side 62 (FIG. 1) of the holding body 44 to the underside 46. In this case, a recess 60 is connected to a likewise continuous slot 64, the slots 64 being oriented essentially parallel to a longitudinal axis 66 of the holding body 44. In this case, the recesses 60 with their slots 64 are arranged essentially symmetrical to this longitudinal axis 66.

A string holding element 68, and in particular a string adjuster, may be inserted into a recess 60, on which a hook 70 may be disposed to swivel, which projects over the slot 64 on the upper side 62 of the string holder 42. By means of an adjusting screw 72, this hook 72 can be swivelled in the direction of the adjusting screw 72 to allow a fine tuning of the strings to be conducted.

By loosening the adjusting screw, the hook 70 can then be swivelled in the slot 64 a long distance from the adjusting screw 72 and the associated string 24 of the violin 10 can be looped into the hook 70 accordingly, and then by tightening the adjusting screw 72, the hook 70 can be swivelled with the looped string 24 in the direction of the adjusting screw 72 and fixed in any position and can thus fix the string 24 to the string holder 42 via the holding device 58.

However, a holding device can also be provided, for example, for the strings which has integrated angle levers. Such a holding device is known from the prior art (e.g. by the product "Light Alloy String holder with 4 String Adjusters" of the Applicant).

Because of the trough-shaped configuration of the holding body 44, the string holding elements 68 are essentially covered outwardly when the string holder 42 is disposed on the covering board 16 of the violin with its underside 46 facing this.

To form the holding device 58, the front region 56 of the holding body 44 is widened in relation to a rear region 74, said rear region 74 being widened again towards a rear end 76 on the attachment element side. As a result, the holding body 44 has a waisted transition region 78, in which the distance between opposite outer walls 80 is at its shortest.

In a variant of an embodiment, boundary surfaces 82 of the outer walls 80 on the underside are located in one plane to thus obtain a trough-shaped configuration of the underside 46 of the holding body 44 in a simple manner, and to be able to cover the adjusting device 48 to the outside in relation to an outside of the string holder 42 remote from the underside 46.

The adjusting device 48 has a bridge element 84, which in particular is formed on the holding body 44 in one piece. This bridge element has a central cylindrical recess 86, which is oriented parallel to the longitudinal axis 66 of the holding body 44, and a projection of the recess 86 onto the holding body 44 is coaxial to the longitudinal axis 66.

A respective recess 88 and 90 is also disposed parallel to the longitudinal axis 66 to the left and right symmetrically to the recess 86. In this case, the recess 86 serves as sliding guide device of an adjusting element 92 of the adjusting device 48, whereas recesses 88 and 90 serve as sliding guide device of the attachment element 54.

The attachment element 54 has a first bow element 93 and a second bow element 94 for formation of the attachment bow 52. These two bow elements 93 and 94 are provided with a thread 96 at their respective ends. Outside this thread 96, the attachment element is encased, for example, in a plastic sheath. In particular, the attachment element 54 is encased in a plastic sheath in the region of the attachment bow 52 for looping into the saddle button 32.

The attachment bow 52 is formed as a result of the attachment element 54 being held on a cross element 98 via the two bow elements 93 and 94. For this purpose, this cross element has recesses provided for the first bow element 93 and the second bow element 94 (FIG. 3), through which the regions of the respective bow elements 93 and 94 provided with the thread 96 can be threaded. A respective holding element 100, e.g. a knurled nut, is then tightened via the thread 96 until it abuts against the cross element 98. The relative movement of the attachment bow 52 from the cross element 98 in the direction of the apex 50 is then restricted by the abutment of the holding element 100 against the cross element 98.

The recesses 88 and 90 are configured in such a manner that the holding element 100, e.g. a knurled nut, can be guided in them, the size of the recess being adapted to the size of the holding element 100 so that the sliding guide device formed is substantially free from play.

The extent of the bow in relation to the cross element 98 may be adjusted respectively for the two bow elements 93 and 94 by the distance between one end of the first bow element 93 or the second bow element 94 and the tightened holding element 100.

To prevent the generation of any disruptive extraneous noises through the free ends of the bow elements 93 and 94, a respectively opposing trough-shaped region 102 is provided in the holding body 44, in which the free ends can lie and in particular be clamped.

These trough-shaped regions 102 are formed in particular by means of a holding tongue 104 disposed in one piece on the underside 46 of the holding body 44. This holding tongue has a recess 106, on which a threaded guide is disposed to be secure against rotation and displacement by insertion of a hexagonal nut 108, for example.

The adjusting element 92 in the form of an adjusting screw is in turn guided in this hexagonal nut 108 so that by rotating the adjusting element 92 in the hexagonal nut 108 this can execute a translational movement relative to the holding body 44 disposed in the recess 86.

Figure 3:
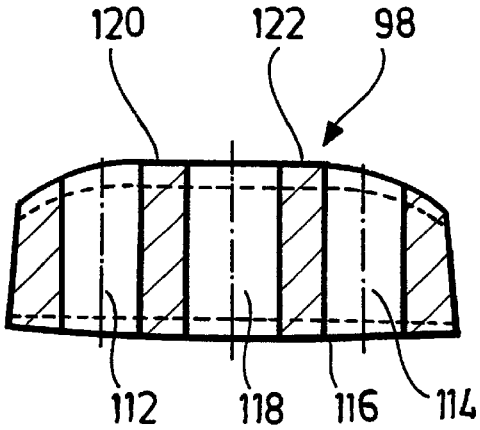
FIG. 3 is an enlarged representation of a sectional view of a cross element according to FIG. 2.

In this case, the adjusting element 92 has an adjusting head 110, which can be brought into abutment against a side of the cross element 98 facing the attachment bow 52. For this, the cross element 98 has a corresponding recess in order to guide the adjusting element through this (FIG. 3).

By rotating the adjusting element 92, this can now be moved in a translational manner in the direction of the bridge element 84, and as a result the cross element 98 is entrained and thus the distance of the apex 50 of the attachment bow 52 from the holding body 44 is in turn decreased.

If the adjusting element 92 is rotated in the opposite direction, then the cross element 98 can thus move away from the bridge element 84 and the distance A between the apex 50 of the attachment bow 52 and the holding body 44 can therefore be increased.

Since the adjusting head 110 of the adjusting element 92 is disposed at the rear end 76 of the holding body 44 on the attachment element side, the adjusting element can be operated from the rear, for example, by a screwdriver, i.e. operated from the rear outside of the string holder 42. The risk of damage to the musical instrument such as scratches in the surface or similar is minimized as a result of this, since the possible impact surface of the musical instrument on operation of the adjusting device from this outside is minimized.

As FIG. 3 shows, the cross element has respective recesses 112 and 114 for threading the first bow element 93 and the second bow element 94 through it in order to thus guide these through the cross element 98 and to fix them by means of the associated holding elements 100 to a side 116 facing the bridge element 84 by abutment of the holding elements 100 against this side 116. At least in the region of the recesses 112 and 114 the side 116 is slightly angled (FIG. 3) in this case, so that upon abutment of the holding elements 100, e.g. knurled nuts, these can abut under tension against walls of the recesses 88 and 90 in the bridge element 84. This prevents a possible swishing sound of the attachment element 54 and in particular of its free ends.

As already mentioned, a cylindrical recess 118 is also provided in the cross element 98 for the adjusting element 92, and an abutment surface 122 is formed for the adjusting head 110 of the adjusting element 92 on a side 120 opposite side 116 so that on operation of the adjusting device 48 the cross element 98 is displaceable with respect to the holding body 44 via the adjusting element 92 from the rear end 76 of the holding body 44.

It can also be provided that in place of a separate hexagonal nut 108, a thread for an adjusting element of the adjusting device is drilled directly in a holding tongue corresponding to holding tongue 104 so that the adjusting element may be displaced in a translational manner relative to the holding body 44. As an alternative or in addition thereto, it can also be provided that a thread is disposed in the bridge element 84 and in particular in the region of the recess 86.

The string holder 42 according to the invention operates as follows:

Via the holding elements 100 constructed in particular in the form of knurled nuts, one size of the attachment bow 52 may be pre-adjusted by correspondingly adjusting the distance of the respective ends of the first bow element 93 and the second bow element 94 from the associated holding element 100 and thus from the cross element 98.

The strings 24 of the violin 10 are then fixed to the holding device 58 of the string holder 42 and via the attachment bow 52 the string holder 42 is fixed to the saddle button 32 of the violin 10 by means of the attachment element 54. The violin may then be tuned.

If it should occur that the ratio of the lengths of primary string 38 to secondary string 40 has to be changed, then with the string holder 42 according to the invention it is not necessary to release the strings (four strings in a violin) at the pegs 22 again and detach the string holder from the violin 10, instead the desired ratio can be adjusted by the adjusting device 48:

The adjusting element 92 for adjusting the distance between the apex 50 of the attachment bow 52 of the attachment element 54 and the holding body 44 with its holding device 58 can be operated by a screwdriver, for example, from a rear end 76 of the holding body 44. For example, if it becomes necessary for the length of the secondary string to be increased, then the adjusting element 92 is displaced in a translational movement in the direction of the holding device 58. As a result, the cross element 98 is entrained in this direction relative to the holding body 44 and also the attachment bow 52 with it, i.e. the distance of its apex 50 in relation to the holding body 44 is decreased. However, since the position of the cross element 98 is fixed in relation to the violin 10, the holding device 58 is moved away from the bridge 36 and the secondary string 40 is lengthened.

If it becomes necessary for the length of the secondary string 40 to be decreased, then the adjusting element 92 is rotated accordingly in the opposite direction. Since the strings are under tension, the cross element 98 is thus automatically moved outwards and away from the holding device 58, i.e. in relation to the holding body 44, so that the distance of the apex 50 from the holding device 58 is increased and thus the length of the secondary string 40 is decreased. Since the position of the cross element 98 is fixed in relation to the violin 10, the holding device 58 moves towards the bridge 36 and the length of the secondary string 40 is decreased.

The bow elements 93 and 94 are respectively directed with their associated holding elements 100 in the recesses 88 and 90 during the movement. In this case, any swishing sound of the attachment element 54 is prevented as a result of the angled configuration of the side 116.

The adjusting element 92 does change its translational position relative to the holding body 44, but not relative to the musical instrument 10. This assures that a screwdriver, for example, does not have to engage deeply above the covering board 16 of the musical instrument 10.

Figure 4:
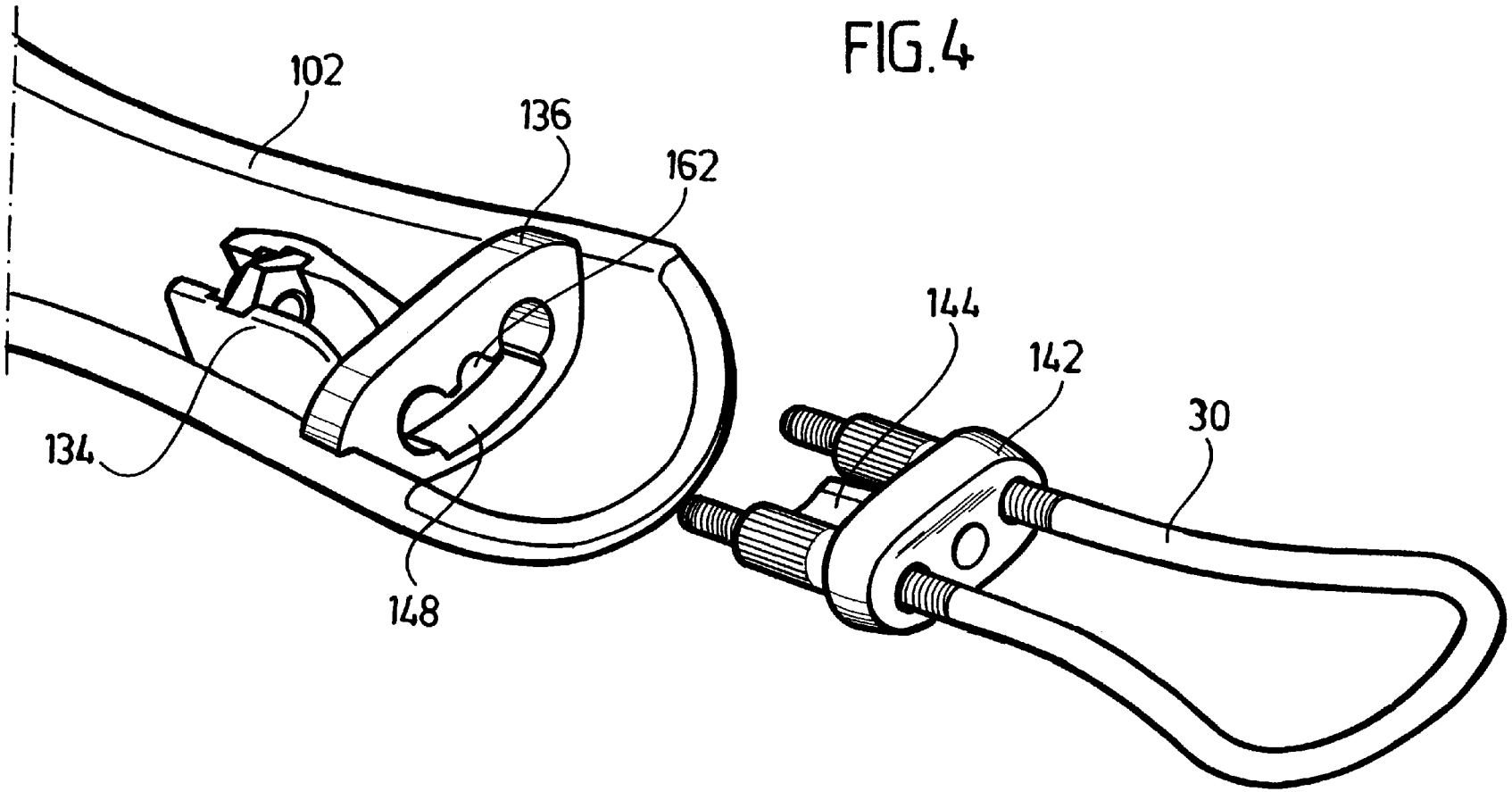
FIG. 4 is a perspective partial view of a variant of a string holder, which has a securing means against loss for an attachment element, wherein a holding body and an attachment element separated therefrom are shown.
Figure 5:
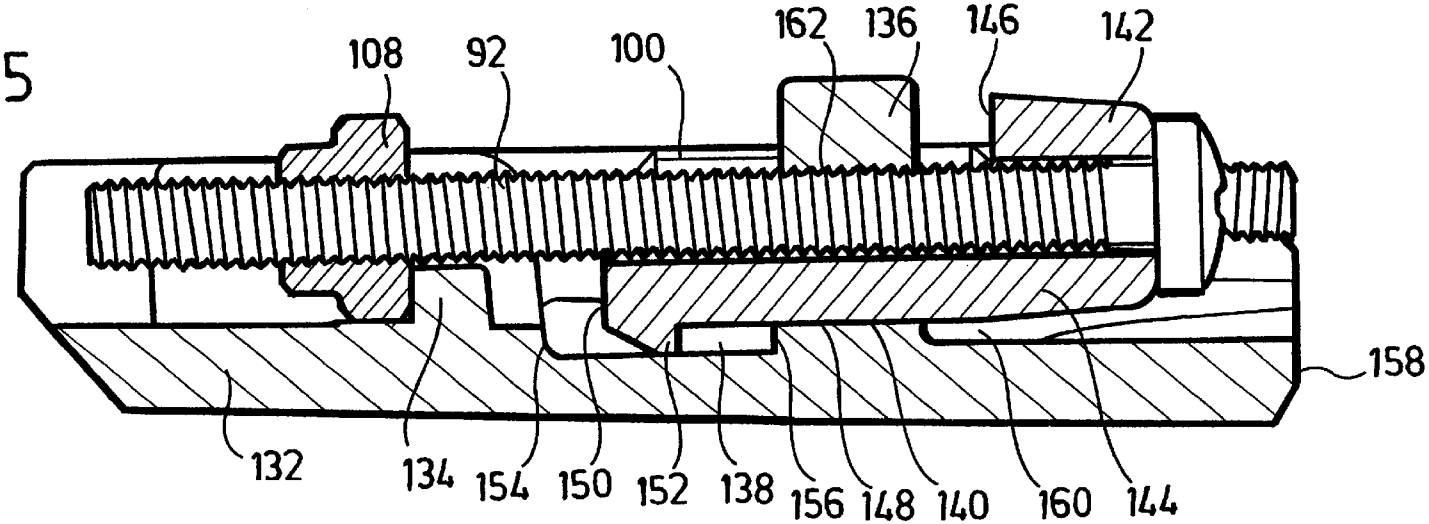
FIG. 5 is a sectional view through the holding body according to FIG. 5 in a central plane, wherein the attachment element is fixed to the holding body via a cross element.
Figure 6:
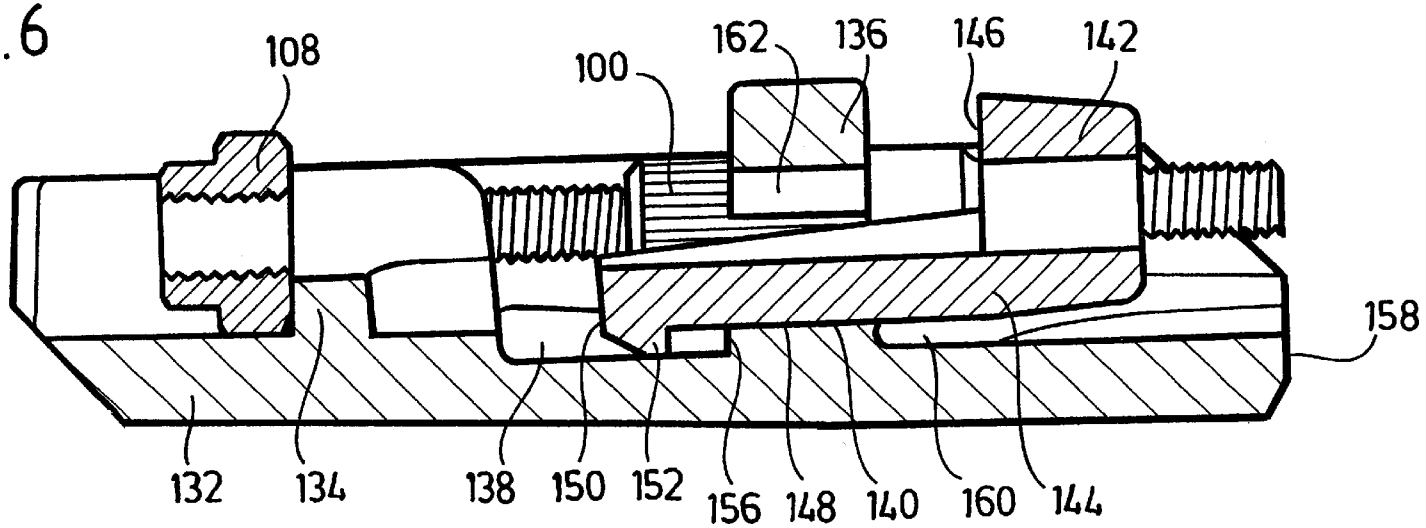
FIG. 6 is a further sectional view displaced to the central plane, wherein the adjusting screw is released from the holding body.

In a variant of an embodiment, which is shown in FIGS. 4 to 6, a corresponding holding body 132 is provided which is slightly modified in relation to holding body 44:

A guide recess 138 is formed in the holding body 132 between a holding tongue 134 for receiving the threaded guide and in particular a hexagonal nut 108 for the adjusting screw 92 as adjusting element (FIGS. 5, 6) and a bridge element 136, in which the attachment element 54 is directed. This guide recess is configured, for example, in an essentially parallelepipedal shape and in the form of a depression on a trough-shaped underside 140 of the holding body 132.

As described above, the attachment element 54 is held on a cross element, which in the variant according to FIGS. 4 to 6 bears the reference number 142. In particular, the mode of fixing the attachment element 54 to the cross element 142 in this case is exactly the same as described above for cross element 98.

A tongue 144 facing the underside 140 of the holding body 132 and extending to project beyond an abutment surface 146 of the cross element 142 onto the bridge element 136 is formed in one piece on the cross element 142. In this case, the bridge element 136 has a recess 148 adapted to the tongue 144 so that the cross element 142 is displaceable relative to the bridge element 136 with the tongue 144, and a front end 150 of the tongue 144 can dip into the intermediate area between the holding tongue 134 and the bridge element 136.

A catch lug 152, which dips into the guide recess 138, in turn sits as holding lug on the tongue 144. In this case, a front end 154 of the guide recess 138 defines a minimum distance of the apex 50 of the attachment bow 52 from the holding body 132 in that the catch lug 152 abuts against this front end 154 there, and therefore the further movement of the cross element 142 in the direction of the holding device 58 for the strings 24 of the musical instrument is blocked. It is provided in particular in this case that, at the same time or alternatively already beforehand, the movement is blocked by abutment of the abutment surface 146 of the cross element 142 against the bridge element 136.

The maximum distance of the apex 50 of the attachment bow 52 is defined by the catch lug 152 abutting against a rear end 156 of the guide recess 138. The movement of the cross element 142 with the attachment element 30 away from the holding body 132 parallel to a guide direction of the guide recess 138 is blocked as a result. A recess 160 is formed between the bridge element 136 and a rear end 158 of the holding body 132 so that, when the adjusting screw 92 is not positioned above the catch lug 152, the cross element 142 may be tilted in the recess 148 of the bridge element 136 towards the underside 140 of the holding body 132 to thus be able to lift the catch lug 152 out of the guide recess 138 and to then guide it through the recess 148 and thus release the attachment element 54, which is fixed to the cross element 142, from the holding body 132 (FIG. 6).

If, conversely, the adjusting screw 92 is positioned such that it passes through the bridge element 136 and is positioned above the tongue 144, then this blocks the tilting movement and the catch lug 152 cannot be tilted out of the guide recess 138. As a result, the cross element 142 is in turn secured with the attachment element 54 against release from the holding body 132. This securing action is effective irrespective of whether the adjusting screw 92 is held in the threaded guide of the holding tongue 134 or not, since it essentially only hinders the tilting movement in the case of positioning above the tongue 144. A guide recess 162 for the adjusting screw 92 in the bridge element 136, the dimensions of the catch lug 152 and of the guide recess 138 and also the cross-sections and guide direction of the adjusting screw 92 are adapted accordingly to assure this securing function.

Therefore if a user rotates the adjusting screw 92 out of the hexagonal nut 108 on adjusting the distance of the apex 50 from the holding body 132, then the attachment element is not thereby automatically released from the holding body (it should be ensured that a tensile force is exerted between the holding body 132 and the attachment element 30 when the string holder is fixed on the violin 10), but the securing device formed by means of the catch lug 152 and the guide recess 138 secures against release of the cross element 142 from the holding body 132. The attachment element 54 can only be released from the holding body 132 when the user purposefully rotates the adjusting screw 92 further and essentially unscrews it completely so that it no longer protrudes through the bridge element 136.

Otherwise, the string holder with the holding body 132 functions exactly as described above.

What is claimed is:

1. String holder for a musical instrument with a holding body, on which a holding device for strings of the musical instrument is disposed and which is provided with an attachment element forming an attachment bow for fixing the holding body to the musical instrument, wherein an adjusting device for adjustment of the distance (A) of an attachment bow apex of the attachment element from the holding body is disposed on the holding body, and the adjusting device is operable from outside the holding body without detaching the string holder from the instrument.

2. String holder according to claim 1, wherein the adjusting device comprises an adjusting element for adjusting the distance (A) of the attachment bow apex, which is operable from outside the holding body.

3. String holder according to claim 2, wherein the adjusting device comprises a single adjusting element.

4. String holder according to claim 2, wherein the adjusting element is operable from an end of the holding body remote from the holding device for the strings of the musical instrument.

5. String holder according to claim 2, wherein the adjusting element is operable from an end of the holding body, via which the attachment element is connected thereto.

6. String holder according to claim 2, wherein the adjusting element is capable of translational movement relative to the holding body.

7. String holder according to claim 2, wherein the adjusting element is capable of translational movement essentially parallel to a longitudinal direction of the holding body.

8. String holder according to claim 7, wherein a sliding guide device is provided for the adjusting element.

9. String holder according to claim 2, wherein the adjusting element is an adjusting screw.

10. String holder according to claim 9, wherein a threaded guide for the adjusting screw is disposed to be secure against rotation and non-displaceable on the holding body, so that upon rotation of the adjusting screw relative to the holding body said screw is capable of translational displacement.

11. String holder according to claim 2, wherein by operating the adjusting element when an attachment element is attached to the musical instrument and strings of the musical instrument are held via the holding device, a distance (A) of the attachment bow apex from the holding body is adjustable.

12. String holder according to claim 2, wherein in the arrangement on a musical instrument, the relative translational position of the adjusting element to the musical instrument is retained.

13. String holder according to claim 2, wherein a securing device to prevent loss is provided for the attachment element when the adjusting element is released.

14. String holder according to claim 1, wherein the adjusting device is disposed on an underside of the holding body which has a trough-shaped construction at least in the region of the adjusting device.

15. String holder according to claim 1, wherein the adjusting device is constructed essentially symmetrically in relation to a longitudinal axis of the holding body.

16. String holder according to claim 1, wherein an attachment element is provided with a thread in the region of its ends.

17. String holder according to claim 1, wherein the attachment element for the formation of an attachment bow via a first bow element and a second bow element is held on a cross element.

18. String holder according to claim 17, wherein a bow element is held on the cross element via a holding element, the holding element being disposed between an end of the bow element and the cross element.

19. String holder according to claim 18, wherein the cross element has an abutment surface for a holding element which is angled.

20. String holder according to claim 18, wherein the holding element is a knurled nut.

21. String holder according to claim 18, wherein the distance between the end of a bow element and the holding element is adjustable for adjustment of the extent of the attachment bow.

22. String holder according to claim 17, wherein the cross element is positionable in a translational manner in relation to the holding body via the adjusting device.

23. String holder according to claim 17, wherein a sliding guide device is provided for the respective portion of the first bow element and the second bow element, which lies between the respective end and the cross element.

24. String holder according to claim 23, wherein the sliding guide device is formed by a recess in a bridge element.

25. String holder according to claim 24, wherein a sliding guide device for the adjusting element is also formed in the bridge element.

26. String holder according to claim 17, wherein the cross element has a holding lug, which is guided in a guide recess of the holding body and by means of which a movement of the cross element away from the holding body is blockable.

27. String holder according to claim 26, wherein the holding lug is disposed on a tongue of the cross element.

28. String holder according to claim 26, wherein the holding lug is disposed and configured in such a way that exit from the guide recess is blockable via the adjusting element.

29. String holder according to claim 28, wherein when the adjusting element is positioned above the catch lug, its exit from the guide recess is blocked.

30. String holder according to claim 26, wherein the guide recess between a threaded guide for an adjusting screw as adjusting element and a bridge element of the holding body is disposed on said holding body or is formed therein.

31. String holder according to claim 1, wherein a specific adjustment range of the adjusting device is predetermined.

* * * * *